US007422384B2

(12) United States Patent
Schalk et al.

(10) Patent No.: US 7,422,384 B2
(45) Date of Patent: Sep. 9, 2008

(54) SYSTEM AND A METHOD FOR PRINTING SMALL PRINT JOBS

(75) Inventors: Wesley Schalk, Camas, WA (US); Mike M. Morrow, Salem, OR (US)

(73) Assignee: Hewlett-Packard Development, L.P., Houston, TX (US)

( * ) Notice: Subject to any disclaimer, the term of this patent is extended or adjusted under 35 U.S.C. 154(b) by 401 days.

(21) Appl. No.: 10/912,330

(22) Filed: Aug. 5, 2004

(65) Prior Publication Data

US 2005/0206707 A1 Sep. 22, 2005

Related U.S. Application Data

(60) Provisional application No. 60/554,215, filed on Mar. 17, 2004.

(51) Int. Cl.
*B41J 3/36* (2006.01)
*B41J 29/38* (2006.01)

(52) U.S. Cl. ..... 400/88; 400/76; 400/613; 710/15; 710/19; 347/109

(58) Field of Classification Search ..... None
See application file for complete search history.

(56) References Cited

U.S. PATENT DOCUMENTS

| | | | | |
|---|---|---|---|---|
| 4,836,697 | A | 6/1989 | Plotnick et al. | |
| 5,028,934 | A | 7/1991 | Kasai et al. | |
| 5,608,443 | A | 3/1997 | Palmer et al. | |
| 5,864,332 | A * | 1/1999 | Young | 715/788 |
| 6,042,950 | A | 3/2000 | Heau et al. | |
| 6,088,049 | A | 7/2000 | Austin et al. | |
| 6,092,940 | A | 7/2000 | Wiklof et al. | |
| 6,563,133 | B1 | 5/2003 | Tong | |
| 6,845,408 | B1 * | 1/2005 | Lemke et al. | 710/18 |
| 7,021,844 | B2 * | 4/2006 | Tanaka et al. | 400/61 |
| 7,033,017 | B2 * | 4/2006 | Silverbrook | 347/109 |
| 2002/0087592 | A1 * | 7/2002 | Ghani | 707/500 |
| 2002/0138564 | A1 * | 9/2002 | Treptow et al. | 709/203 |
| 2003/0020915 | A1 | 1/2003 | Schueller et al. | |
| 2003/0081831 | A1 * | 5/2003 | Fukao et al. | 382/167 |
| 2003/0087110 | A1 | 5/2003 | Furusawa et al. | |
| 2003/0145940 | A1 | 8/2003 | Chaudhury et al. | |
| 2003/0167447 | A1 * | 9/2003 | Hatta et al. | 715/517 |

(Continued)

FOREIGN PATENT DOCUMENTS

| | | |
|---|---|---|
| DE | 3787300 | 1/1994 |

(Continued)

OTHER PUBLICATIONS

Machine translation of JP 2003-085163 to Iwanaga et al. from Japanese Patent Office website.*

(Continued)

*Primary Examiner*—Daniel J Colilla

(57) ABSTRACT

An image forming device includes a protective case, a media source disposed in the protective case, the media source supplying an image receptive media, an encoder configured to detect an advancement of the image receptive media, and a pen coupled to the protective case, the pen including an immovable print head configured to deposit ink onto the image receptive media.

42 Claims, 14 Drawing Sheets

U.S. PATENT DOCUMENTS

| | | | | |
|---|---|---|---|---|
| 2003/0211705 | A1 | 11/2003 | Tong et al. | |
| 2004/0033639 | A1 | 2/2004 | Chin et al. | |
| 2004/0080600 | A1 * | 4/2004 | Lo et al. | 347/105 |
| 2004/0126083 | A1 * | 7/2004 | Katano et al. | 386/46 |
| 2004/0126993 | A1 | 7/2004 | Chan et al. | |
| 2006/0036706 | A1 * | 2/2006 | Sakamoto | 709/217 |

FOREIGN PATENT DOCUMENTS

| | | | | |
|---|---|---|---|---|
| JP | 61035391 | | | 2/1986 |
| JP | 63221063 | A | * | 9/1988 |
| JP | 63227360 | A | * | 9/1988 |
| JP | 63290780 | | | 11/1988 |
| JP | 09109479 | A | * | 4/1997 |
| JP | 09314918 | | | 12/1997 |
| JP | 10198627 | A | * | 7/1998 |
| JP | 2000347839 | A | * | 12/2000 |
| JP | 2003085163 | A | * | 3/2003 |
| JP | 2003283969 | A | * | 10/2003 |
| WO | WO2004056576 | | | 7/2004 |

OTHER PUBLICATIONS

Machine translation of JP 10-198627 to Sato from Japanese Patent Office website.*

English translation of JP 10198627 to Sato.*

English translation of JP 2000347839 to Tamura et al.*

Petra Amirfeiz and Stefan Bengtsson, Formation of Silicon Structures by Plasma Activated Wafer Bonding, Microtechnology Centre at Chalmers and Solid State Electronics Lab., Dept. of Microelectronics Chalmers University of Technology, http://www.sensonor.com/sesibon/eurosensors2000.pdf.

P. Amirfeiz, A. Weinert and S. Bengtsson, Plasma Assisted Room Temperature Bonding for MST, Microtechnology Centre at Chalmers and Solid State Electronics Laboratory, Department of Microelectronics, Chalmers University of Technology http://www.sensonor.com/sesibon/eurosensors2000.pdf.

* cited by examiner

SYSTEM AND A METHOD FOR PRINTING SMALL PRINT JOBS

RELATED APPLICATIONS

The present application claims priority under 35 U.S.C. § 119(e) from the following previously-filed Provisional Patent Application, U.S. Application No. 60/554,215, filed Mar. 17, 2004 by Wesley Schalk et al., entitled "A system and a method for printing small print jobs" which is incorporated herein by reference in its entirety.

BACKGROUND

Traditional inkjet printing mechanisms use cartridges, often called "pens," which eject drops of liquid colorant, referred to generally herein as "ink," onto a print receiving medium. Each pen has a printhead formed with one or more very small nozzles through which the ink drops are fired. To print a desired image or letters on a print media, nozzles of the inkjet printer eject tiny droplets of ink, or dots, during each horizontal pass of the printhead over the print media, thereby forming a row of dots. Each horizontal pass of a printhead over a print media is called a swath. After each preceding swath, the print media is incrementally advanced. Through a succession of swaths, desired images or letters are printed onto the print media.

Often, printer components such as the moveable carriage, servo mechanisms, and controllable rollers become ineffective due to wear, thereby reducing the durability of traditional inkjet printing mechanisms. Additionally, the inclusion of automation components, feed components, and servicing hardware greatly increase the overall cost of producing the traditional inkjet printing mechanisms.

Moreover, initial setup in traditional printers includes performing a number of lengthy steps. Traditional printers are communicatively coupled to an associated computing device through a serial or a parallel port, often requiring the computing device to be shut down in preparation of connection and recognition. Additionally, initial set up of traditional printers includes the manual loading of associated software. During operation of traditional inkjet printers, printing is often delayed by the opening of a text or graphics supporting application, initiation of the print job, answering the call to select the desired printer from one of any number of available printers, formatting the print job for print quality, paper type and enlargement/reduction of the image, the transmission of the entire print job to the desired printer, saving or the deletion of text after the transmission of a print job, and the closing of the software associated with the print job.

Additionally, when printing a small message or reminder using a traditional inkjet printer, a large amount of paper and other resources are often wasted. In order to print a small message, an entire sheet of paper was traditionally run through the printing device. If the printed message was cut off of the sheet of paper, the reduced paper could not be re-used and was wasted. Moreover, a large number of traditional printing devices would not accept small or odd shaped print mediums for printing, thereby necessitating the use of an entire sheet of paper for each print job.

SUMMARY

An image forming device includes a protective case, a media source disposed in the protective case, the media source supplying an image receptive media, an encoder configured to detect an advancement of the image receptive media, and a pen coupled to the protective case, the pen including an immovable print head configured to deposit ink onto the image receptive media.

Additionally, a system for printing an image includes a computing device for receiving a first input to activate a user interface for entering the image, and a printer communicatively coupled to the computing device, wherein the user interface includes an image receiving area, the image receiving area corresponding to an image receiving media stored in the printer, wherein the first input includes a detected coupling of the printer to the computing device.

BRIEF DESCRIPTION OF THE DRAWINGS

The accompanying drawings illustrate various embodiments of the present method and system and are a part of the specification. The illustrated embodiments are merely examples of the present system and method and do not limit the scope thereof.

Throughout the drawings, identical reference numbers designate similar, but not necessarily identical, elements.

DETAILED DESCRIPTION

A method and an apparatus for economically printing short messages or images from a computing device are described herein. More specifically, a method is described for reducing the overall cost of producing short messages or images while reducing the time necessary to produce such messages or images. A number of exemplary structures and methods of the present economic printing system and method are described in detail below.

As used in this specification and in the appended claims, the term "ink" is meant to be understood broadly as any jettable fluid, with or without colorant that may be selectively ejected by any number of inkjet printing devices. Additionally, the term "jettable" is meant to be understood as a fluid that has a viscosity suitable for precise ejection from an inkjet printing device. Moreover, the term "print medium" is meant to be understood broadly as any substrate or material configured to receive an ink from a printing device including, but in no way limited to, a paper based medium, a plastic based medium such as a transparency, or a cloth based medium.

In the following description, for purposes of explanation, numerous specific details are set forth in order to provide a thorough understanding of the present system and method for economically printing short messages or images from a computing device. It will be apparent, however, to one skilled in the art that the present method may be practiced without these specific details. Reference in the specification to "one embodiment" or "an embodiment" means that a particular feature, structure, or characteristic described in connection with the embodiment is included in at least one embodiment. The appearance of the phrase "in one embodiment" in various places in the specification are not necessarily all referring to the same embodiment.

Exemplary Structure

Figure 1A:
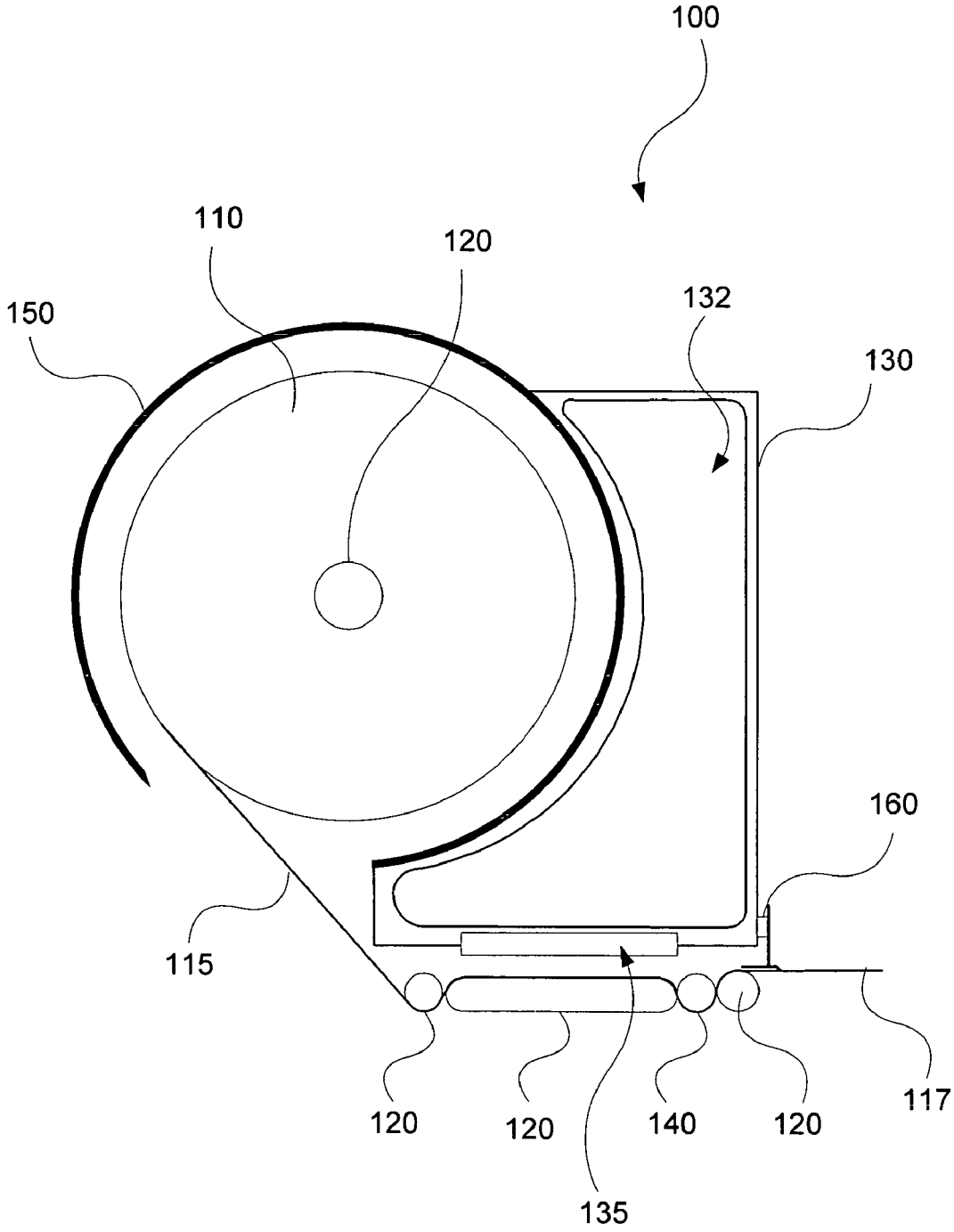
FIG. 1A is a side cutaway view of a compact message printer, according to one exemplary embodiment.

FIG. 1A illustrates a compact message printer (100) according to one exemplary embodiment. As illustrated in FIG. 1A, the compact message printer (100) includes an inkjet pen (130), a media source (110), and an encoder (140) contained within a single protective case (150). According to the exemplary embodiment illustrated in FIG. 1A, the compact message printer (100) also includes a plurality of media guides (120) for aiding in the translation of a print receiving media (115) contained in the media source (110), as well as a serrated edge (160) for removing exposed print receiving media (117). Further explanation of the functional components of the present compact message printer (100) will now be given below with reference to FIGS. 1A and 1B.

As illustrated in FIG. 1A, the protective case (150) of the present compact message printer (100) is configured to protect the internal components of the compact printer from exposure to dust, moisture, or any other environmental condition that could be detrimental to the internal components of the compact printer. According to one exemplary embodiment, the protective case (150) may be constructed of, but is in no way limited to, a plastic, a metal, or a composite.

Additionally, as illustrated in FIG. 1A, the compact message printer (100) includes a pen (130) disposed within the protective case (150). The pen (130) that forms a portion of the compact message printer (100) illustrated in FIG. 1A is configured to print an image on an image receiving media (115) in response to received image data. According to one exemplary embodiment, the pen (130) includes a single large fixed swath inkjet print head (135) and an ink reservoir (132). The size of the inkjet print head (135) corresponds to a swath height of rasterized data. According to one exemplary embodiment, the inkjet print head (135) is approximately 1 inch. Additionally, the inkjet print head (135) is oriented such that the print receiving media (115), when translated, is transported orthogonal to one or more nozzles formed in the inkjet print head (135). The print head (135) may or may not be fully populated, according to various exemplary embodiments.

Additionally, as illustrated in FIG. 1A, the pen (130) includes an ink reservoir (132). According to the exemplary embodiment illustrated in FIG. 1A, the ink reservoir (132) may be formed as an integral part of the protective case (150). According to this exemplary embodiment, the ink reservoir (132) includes an orifice configured to house a predetermined amount of ink. The amount of ink contained in the ink reservoir may include, but is in no way limited to, sufficient ink to print over 100 to 200 message outputs. According to this exemplary embodiment, when the ink is depleted from the ink reservoir (132), the entire compact message printer (100) may be discarded and replaced with a new compact message printer. Alternatively, a replaceable pen (130) and/or ink reservoir (132) may be incorporated into the compact message printer (100) as will be further described with reference to FIGS. 5 and 6 below.

According to one exemplary embodiment, the pen (130) utilized in the present compact message printer (100) includes, but is in no way limited to, a thermally actuated inkjet dispenser, a mechanically actuated inkjet dispenser, an electrostatically actuated inkjet dispenser, a magnetically actuated inkjet dispenser, a piezo-electrically actuated inkjet dispenser, or a continuous inkjet dispensers. Moreover, in contrast to traditional printers, the present compact message printer (100) does not include any servo-mechanisms associated with the pen (130). Rather, the pen (130) is immovably coupled to the compact message printer (100). Rather than including expensive servo-mechanisms, that may be subject to wear and tear, to selectively position the pen (130) adjacent to the print receiving medium, the present pen (130) includes a plurality of nozzles configured to selectively eject ink onto a print receiving medium as it passes the immovable pen (130). Additionally, an encoder (140), explained in further detail below with reference to FIG. 1B, is included in the present compact message printer (100) to facilitate correct image formation on the print receiving medium as it passes by the immovable pen (130).

Figure 1B:
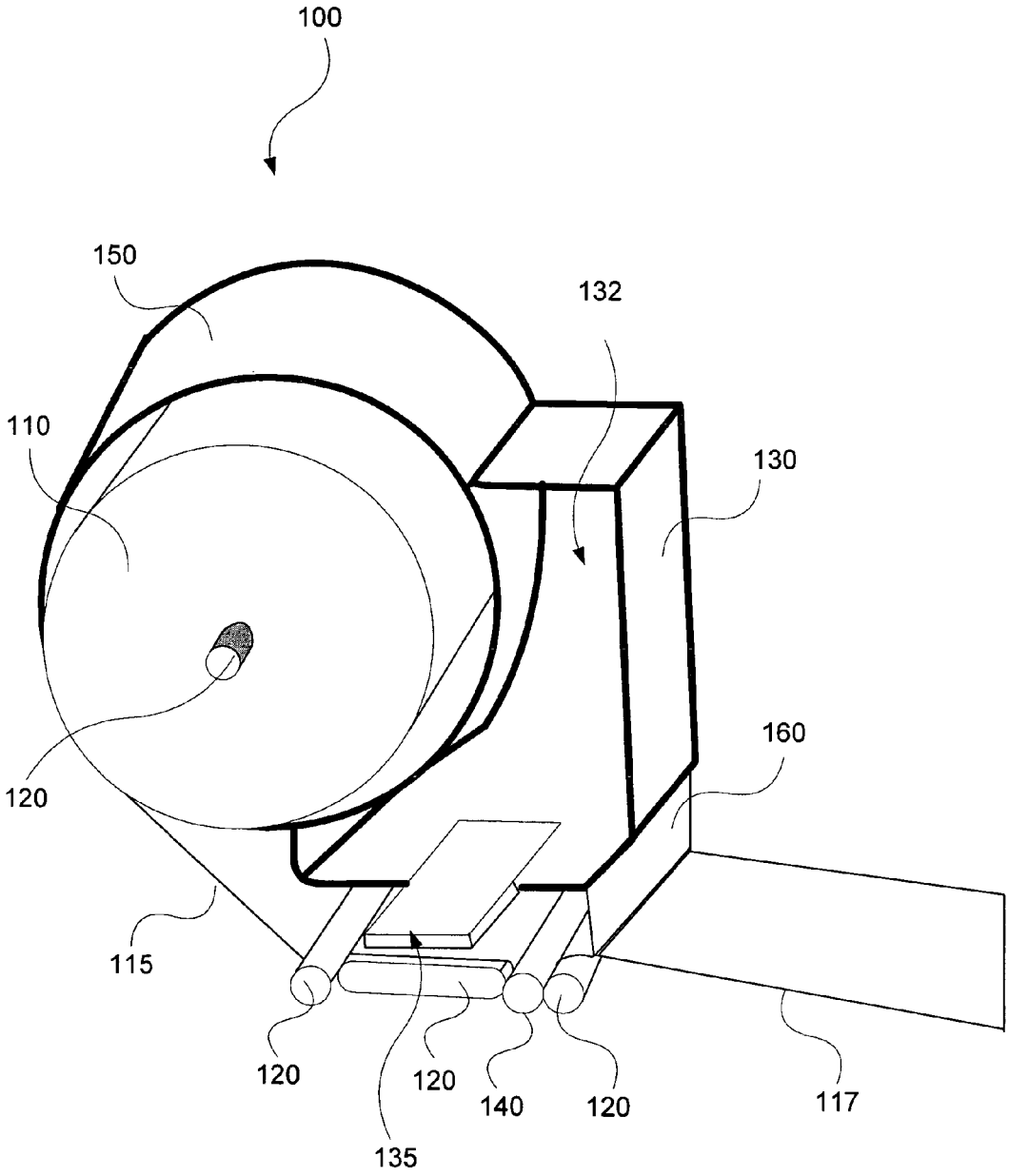
FIG. 1B is a perspective cutaway view of a compact message printer according to one exemplary embodiment.

FIG. 1B is a perspective view of the present compact message printer (100) according to one exemplary embodiment. As illustrated in FIG. 1B, the media source (110) is configured to supply a print receiving media (115) to the pen (130) component of the compact message printer (100). As illustrated in FIG. 1B, the media source (110) may include a print receiving media (115) concentrically wrapped around a hub (120) such as a drag hub. The print receiving media (115) disposed on the media source (110) is configured to be translated adjacent to the print head (135) until severed from the remaining print receiving media (115) by the serrated edge (160).

Figure 2:
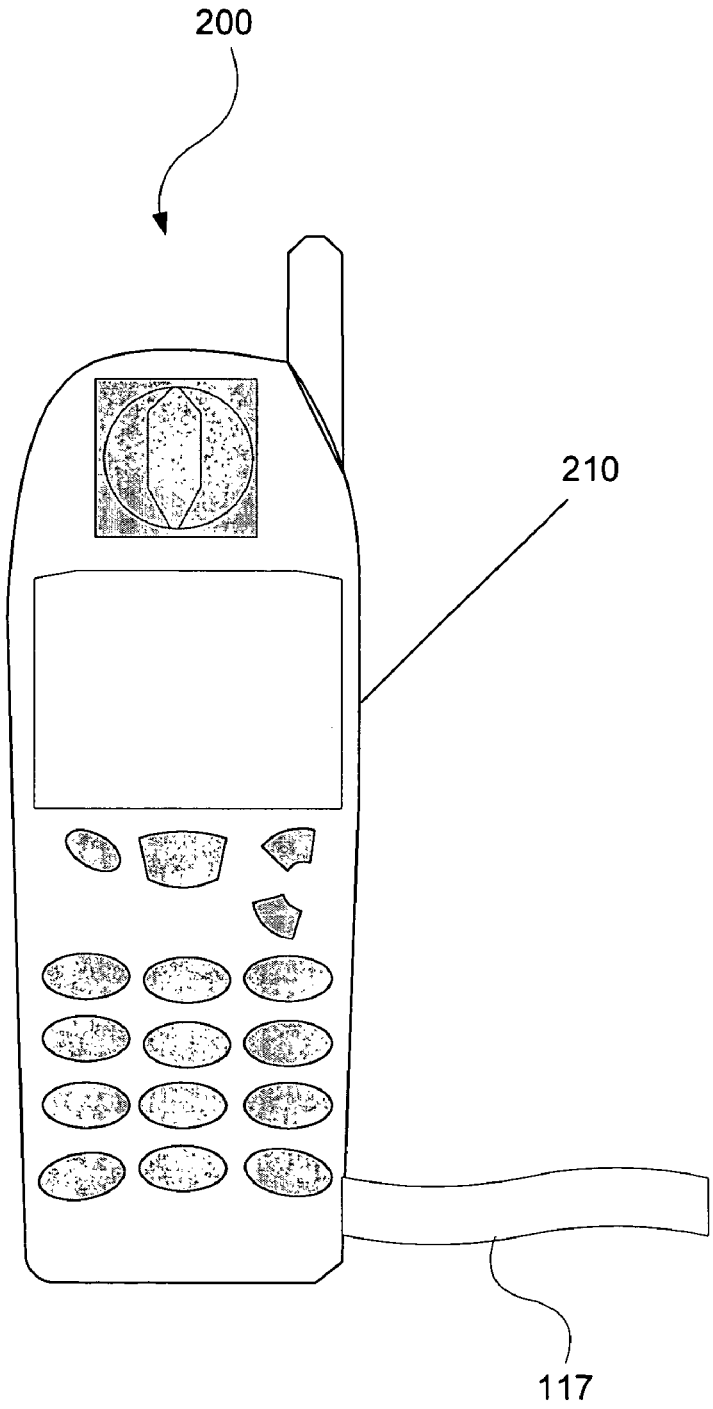
FIG. 2 is a perspective view of a cellular telephone incorporating a compact message printer according to one exemplary embodiment.
Figure 3:
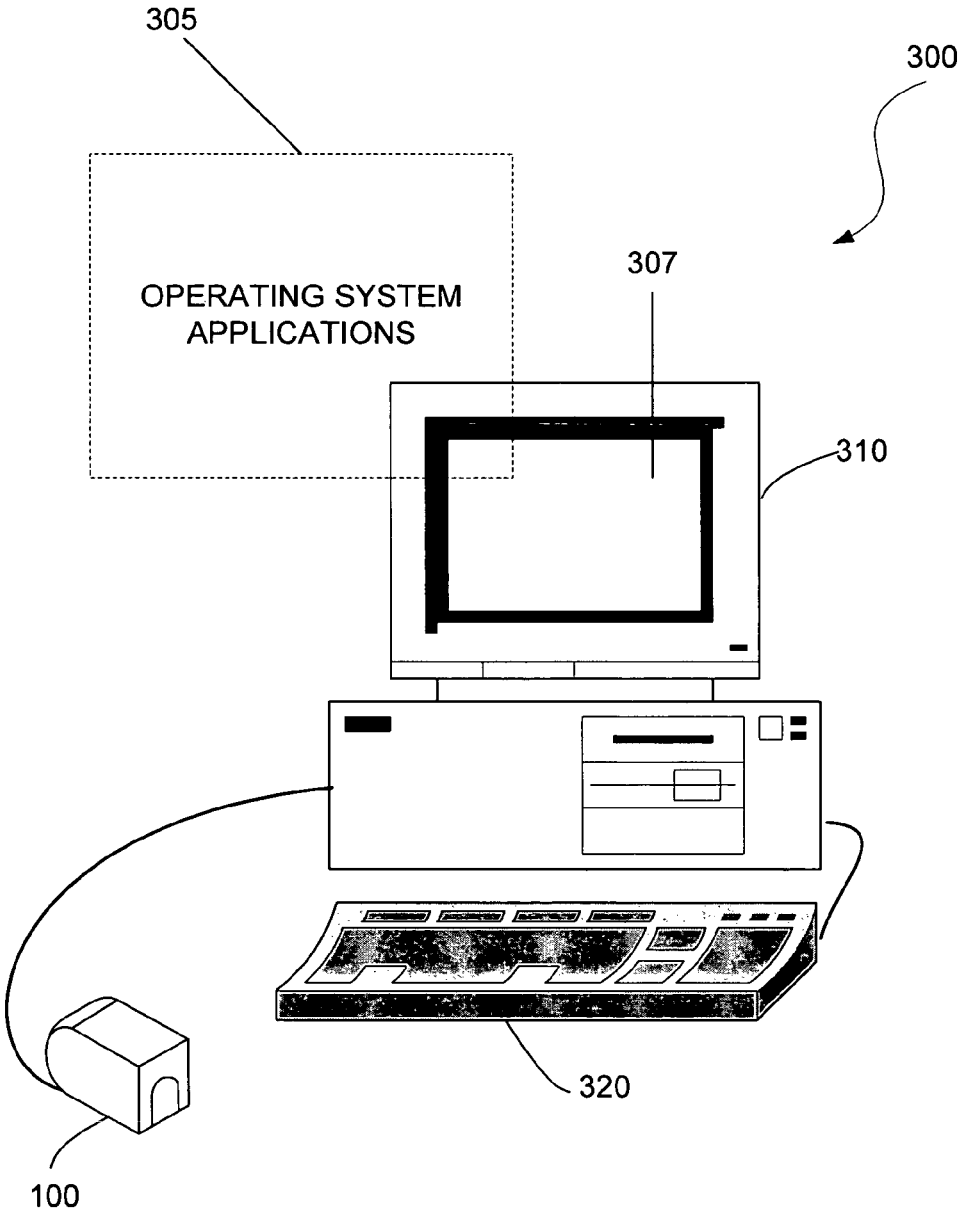
FIG. 3 is simple block diagram illustrating a compact message printing system, according to one exemplary embodiment.

Alternatively, in an embodiment of the compact message printer (100) that does not include a serrated edge (160), the print receiving media (115) may be constructed such that the end of one sheet of print receiving media is removably coupled to the beginning of the next sheet of print receiving media by an adhesive or a perforated section. According to this exemplary embodiment, as the first sheet is removed from the compact message printer (100), the next sheet is advanced into the original position of the first sheet. Alternatively, the media source (110) may also include, but is in no way limited to, a number of lightly coupled sheets stored in a z-fold arrangement or in roll form within the compact message printer (100; FIG. 2). Additionally, the print receiving material (115; FIG. 3) may include adhesive backing similar to traditionally used notes or flags.

As illustrated in FIG. 1B, a media path exists from the media source (110), through a plurality of media guides (120) and onto the inkjet print head (135). From the inkjet printhead (135), the media path continues past additional media guides (120) and out the compact message printer (100). According to the exemplary embodiment illustrated in FIG. 1B, the plurality of media guides (120), positioned both before and after the print head (135), are configured to efficiently guide the print receiving media (115) past the inkjet print head (135). According to one exemplary embodiment, the media guides include metal and/or plastic components having low-friction surfaces.

Additionally, as illustrated in FIG. 1B, an encoder (140) may be placed in the media path configured to sense the velocity of the print receiving media (115) as it passes adjacent to the inkjet print head (135). According to one exemplary embodiment, the resulting velocity detected by the encoder (140) is used by a small logic board (SLB) (not shown), communicatively coupled to the pen (130), to synchronize the emission of ink from the pen (130), thereby forming the desired image. The encoder (140) can also be configured to detect whether the compact message printer (100; FIG. 2) has run out of media. The encoder (140) included in the present compact message printer (100) may include, but is in no way limited to, an optical encoder or a mechanical encoder disposed either before or after the inkjet print head (135).

According to the exemplary embodiment illustrated in FIG. 1B, the media source (110) is disposed on a hub (120) within the protective case (150). In one exemplary embodiment, the hub (120) is a drag hub or another motion dampening device about which the media source (110) is concentrically wound. Consequently, the drag hub (120) is configured to limit how fast the print receiving media (115) can be pulled from the media source (110) and as a result the compact message printer (100). By limiting the speed of the print receiving media (115), the drag hub (120) controls the resulting image quality by assuring that the resulting translation of the print receiving media (115) does not exceed the printable velocity of the pen (130). Alternatively, the velocity of the print receiving media (115) may be reduced by other motion dampening devices such as one or more resistive rollers disposed in the media path, or a resistive encoder (140) that senses and somewhat resists the motion of the print receiving media (115).

As illustrated in FIG. 1B, an exposed print receiving media (117) is illustrated extending beyond the protective case (150) of the compact message printer (100). The exposed print receiving media (117) is positioned adjacent to the pen (130) in order to facilitate reception of an imaging ink onto an unexposed portion of the print receiving media. According to one exemplary embodiment, the exposed print receiving media (117) is sufficiently exposed from the protective case (150) of the present compact message printer (100) to allow a user to physically grasp and/or extract the exposed print receiving media. By allowing the user to provide line feed advance of the print receiving media (115; FIG. 3), through manual extraction, cost of the compact message printer is reduced. Additionally, cost of the present compact message printer is reduced in comparison to traditional printing devices by eliminating a service station, a carriage, a power supply, motors, and precision shafts with rollers.

Also illustrated in FIG. 1B, a serrated edge (160) is coupled to the protective case (150) of the compact message printer (100). The serrated edge (160) is configured to facilitate the removal of a printed text or image on the exposed print receiving media (117) while leaving sufficient exposed print receiving media for grasping or otherwise extracting.

FIG. 2 illustrates a telephone messaging system (200) incorporating the present compact message printer (100; FIG. 1A), according to one exemplary embodiment. As illustrated in FIG. 2, the compact message printer (100; FIG. 1A) may be physically disposed within a cellular telephone (210). According to this exemplary embodiment, received data such as caller identification information or text messages may be transmitted to the compact message printer and subsequently printed. As shown, the exposed print receiving media (117) may then be removed from the cellular telephone (210) containing the desired information. While the exemplary embodiment illustrated in FIG. 2 includes incorporating the present compact message printer into a cellular telephone (210), the present system and method may be physically incorporated into any number of electronic devices including, but in no way limited to, cellular telephones, wireless telephones, payphones, pagers, personal digital assistants (PDAs), watches, personal computers (PC), laptop computers, workstations, televisions, handheld computers, and tablet computers. Additionally, the present compact message printer (100; FIG. 1A) may be externally coupled to any number of electronic devices as illustrated in FIG. 3.

FIG. 3 illustrates a compact printing system (300), according to one exemplary embodiment. As illustrated in FIG. 3, the compact printing system (300) includes a computing device (310) communicatively coupled to both a data input device (320) and a compact message printer (100). The components of the exemplary compact printing system (300) will now be described in further detail below.

As illustrated in FIG. 3, the compact printing system (300) includes a computing device (310). The computing device (310) may be any computing device configured to host an operating system and/or a number of specific applications (305). According to one exemplary embodiment, the computing device (310) forming a portion of the present compact printing system (300) may include, but is in no way limited to, a personal computer (PC), a laptop computer, a tablet computer, a personal digital assistant (PDA), a pocket personal computer (pocket PC), a cellular telephone, a digital watch, or any other processor containing device. According to one exemplary embodiment, the computing device (310) includes a user interface (307) configured to present a graphical and informational display to a user. Additionally, the user interface (307) may include, but is in no way limited to, a monitor, a projector, a plasma screen, a light emitting diode (LED) screen, and the like.

Communicatively coupled to the computing device (310) is one or more data input devices (320) as illustrated in FIG. 3. The data input device (320) is configured to communicate with, and input data to, the computing device and any specific applications (305) running thereon. According to one exemplary embodiment, the data input device (320) includes, but is in no way limited to, a "QWERTY" keyboard, a mouse, an optical mouse, a touchpad, a microphone, or the like.

Figure 4:
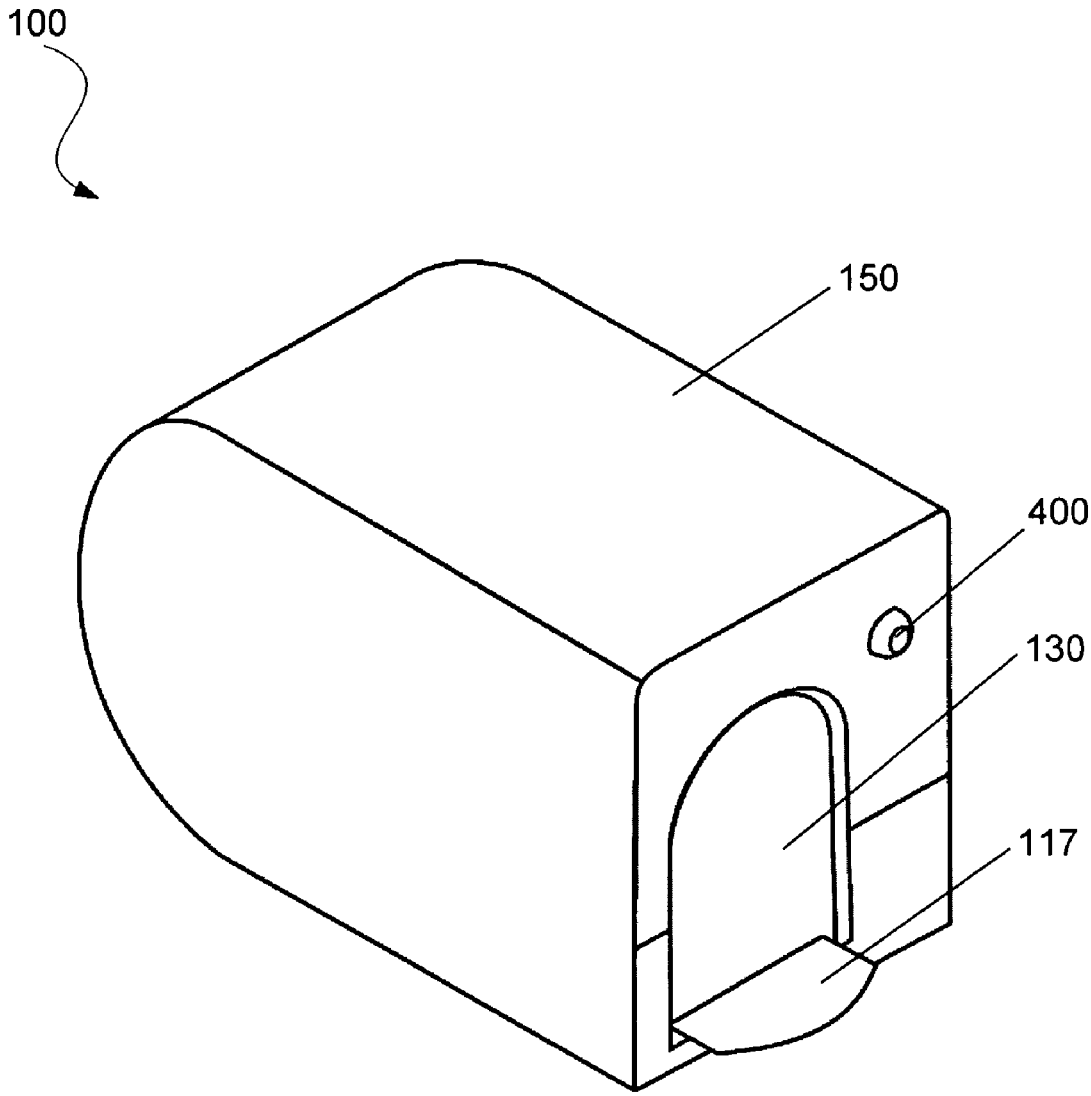
FIG. 4 is an external view illustrating a compact message printer, according to one exemplary embodiment.

Additionally, as illustrated in FIG. 3, a compact message printer (100) according to the present exemplary embodiment is communicatively coupled to the computing device (310). FIG. 4 further illustrates the components of the exemplary compact message printer (100) shown in FIG. 3. As illustrated in FIG. 4, the present compact message printer (100) includes a protective case (150), a pen (130), and an exposed print receiving media (117) as previously mentioned above with reference to FIGS. 1A and 1B. Additionally, the exemplary embodiment illustrated in FIG. 4 includes a function indicator (400).

As shown in FIG. 4, a function indicator (400) is disposed in the protective case (150). The function indicator (400) is configured to signal or otherwise communicate to a user the function being performed by the compact message printer (100). According to one exemplary embodiment, the function indicator may include, but is in no way limited to, a light source such as a light emitting diode (LED). Accordingly, the function indicator (400) is configured to flash or intermittently blink when data is being received by the compact message printer (100) from a coupled computing device (310; FIG. 3). Once a specified portion of data has been transmitted to the compact message printer (100) from the computing device (310; FIG. 3), the function indicator remains illuminated, indicating to the user that the compact message printer (100) is ready to physically produce an image based on the transmitted data. Additionally, the function indicator (400) can also communicate that the compact message printer (100) is out of print receiving media (117), for example, by flashing at a different rate than when receiving data form the computing device (310; FIG. 3).

Figure 5:
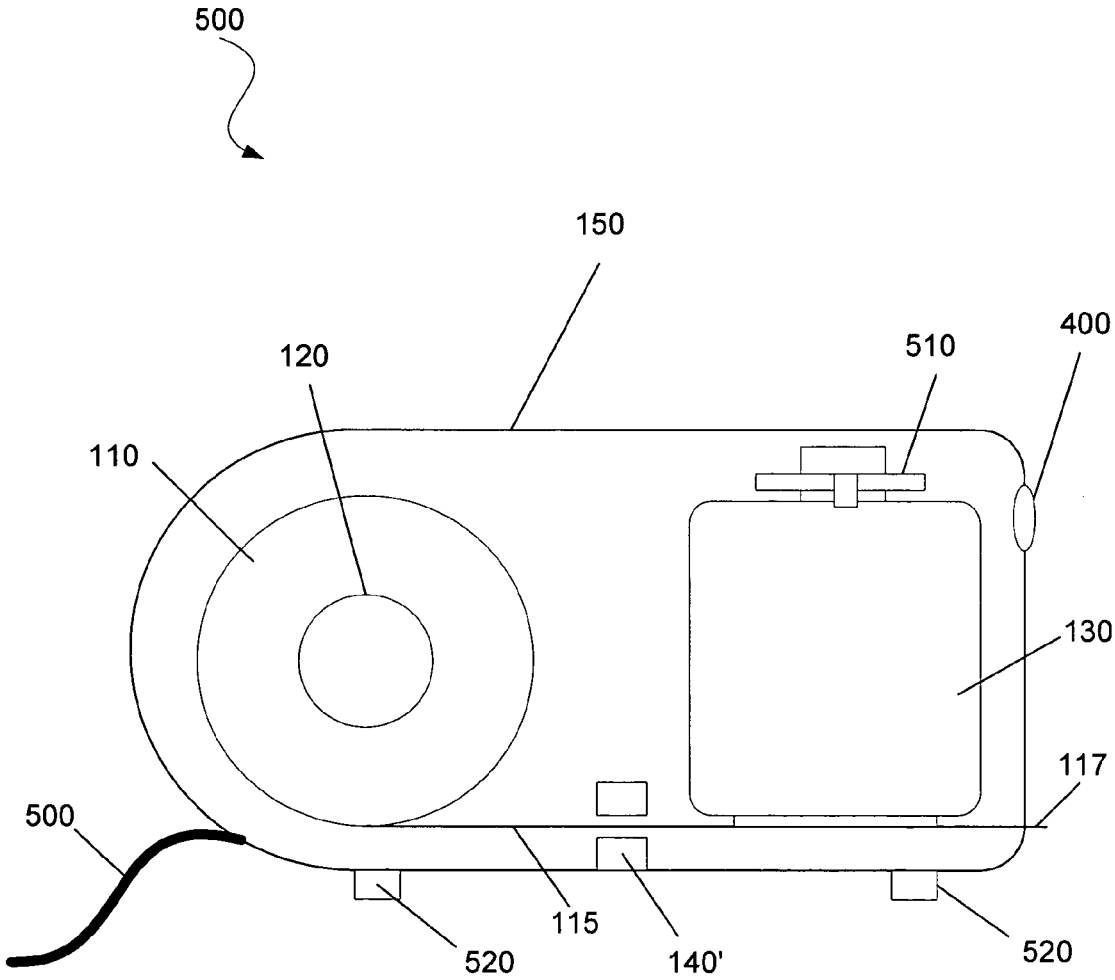
FIG. 5 is a cutaway side view of a compact message printer, according to one exemplary embodiment.

FIG. 5 is a cross-sectional view further illustrating the internal components of the exemplary compact message printer (100) incorporated into the compact printing system (300; FIG. 3). As illustrated in FIG. 5, the exemplary compact message printer (100) includes a number of the internal components illustrated in FIG. 1A. More specifically, the exemplary compact message printer (100) includes a media source (110) containing a print receiving media (115) coupled to a drag hub (120) or other motion dampening device. Additionally, an optical encoder (140') is disposed adjacent to the print receiving media (115) as it leaves the media source (110) on its path to the pen (130).

However, in contrast to the compact message printer (100) illustrated in FIG. 1A, the externally coupled compact message printer illustrated in FIG. 5 includes a pen latch (510) removably coupling the pen (130) to the compact message printer (100). Moreover, the exemplary compact message printer (100) illustrated in FIG. 5 includes a number of protective feet (520) and a cable (500) configured to communicatively couple to the compact message printer (100) to a computing device (310; FIG. 3).

Figure 6:
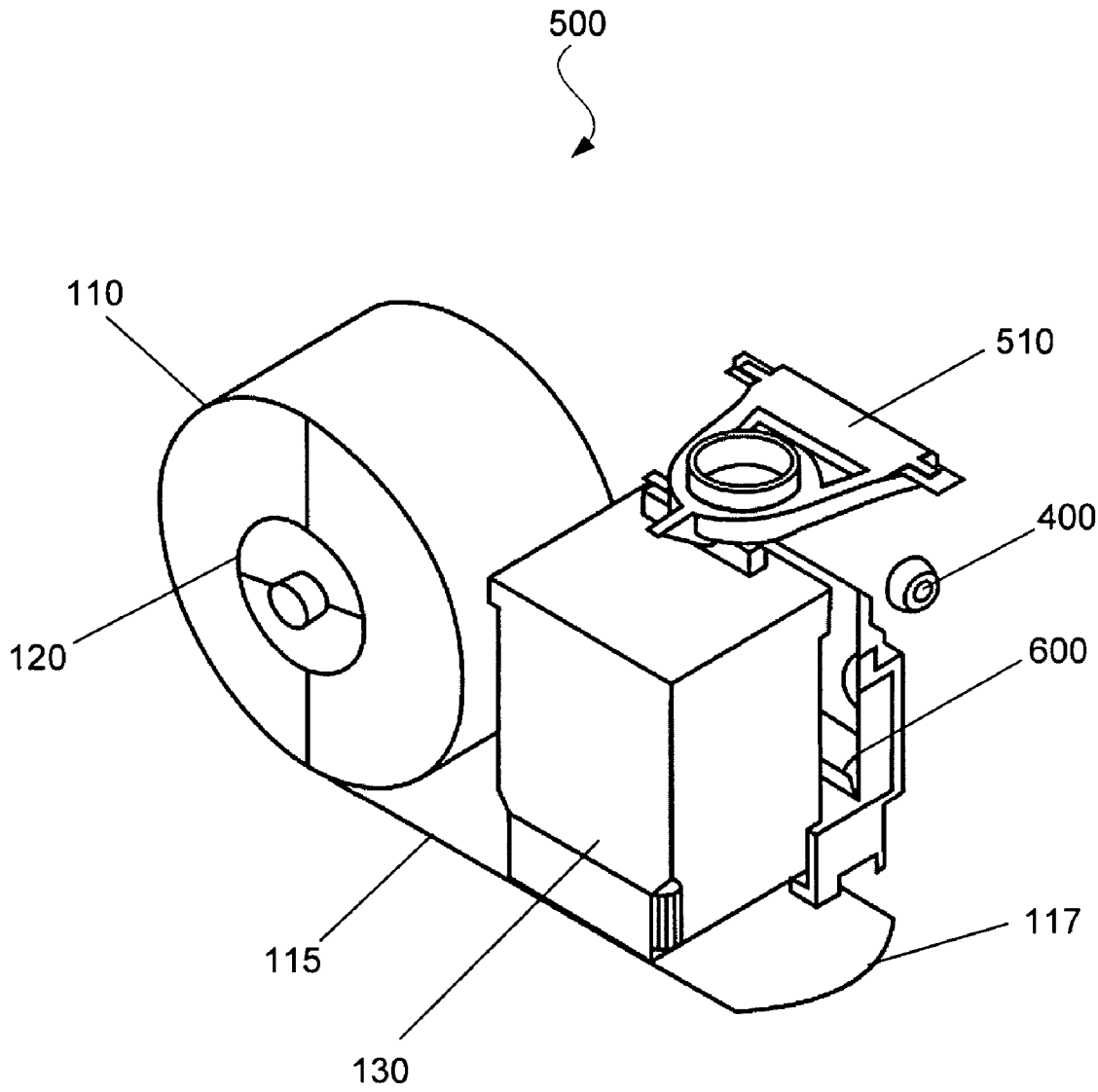
FIG. 6 is a perspective view of the internal components of a compact message printer, according to one exemplary embodiment.

FIG. 6 is a perspective view further illustrating the internal components (500) of the compact message printer (100; FIG. 5). As shown in the exemplary embodiment illustrated in FIG. 6, the media source (110) is configured to supply a print receiving media (115) to the pen (130) component of the compact message printer (100; FIG. 5). According to the exemplary embodiment illustrated in FIG. 6, a pen latch (510) is configured to securely couple the pen (130) to the protective case (150; FIG. 5) of the compact message printer (100; FIG. 5). According to one exemplary embodiment illustrated in FIG. 6, the pen latch (510) is configured to form an interference fit with an extruding portion of the pen (130) body. According to this exemplary embodiment, when a pen (130) is inserted into the compact message printer (100; FIG. 5), the pen latch (510) is forced over the extruding portion of the pen (130), thereby securely coupling the pen to the protective case (150; FIG. 5). Consequently, the pen (130) may be replaced when empty or when another color or type of ink is desired by removing the pen latch (510) to release the pen.

FIG. 6 further illustrates a small logic board (SLB) (600) that is communicatively coupled to the encoder (140'; FIG. 5) and the pen (130). The SLB (600) may be configured to perform a number of functions including, but in no way limited to, processing any data received from the communicatively coupled computing device (310; FIG. 3), detecting the type of media source (110) that has been installed into the compact message printer (100; FIG. 5), lighting the function indicator (400) to allow the user to know when the compact message printer is ready for the print receiving media (115) to be advanced, and to serve as an electrical interconnect for the pen (130). According to one exemplary embodiment, the SLB (600) includes a data storage device (not shown) configured to temporarily store print data prior to performing a print operation.

Figure 7A:
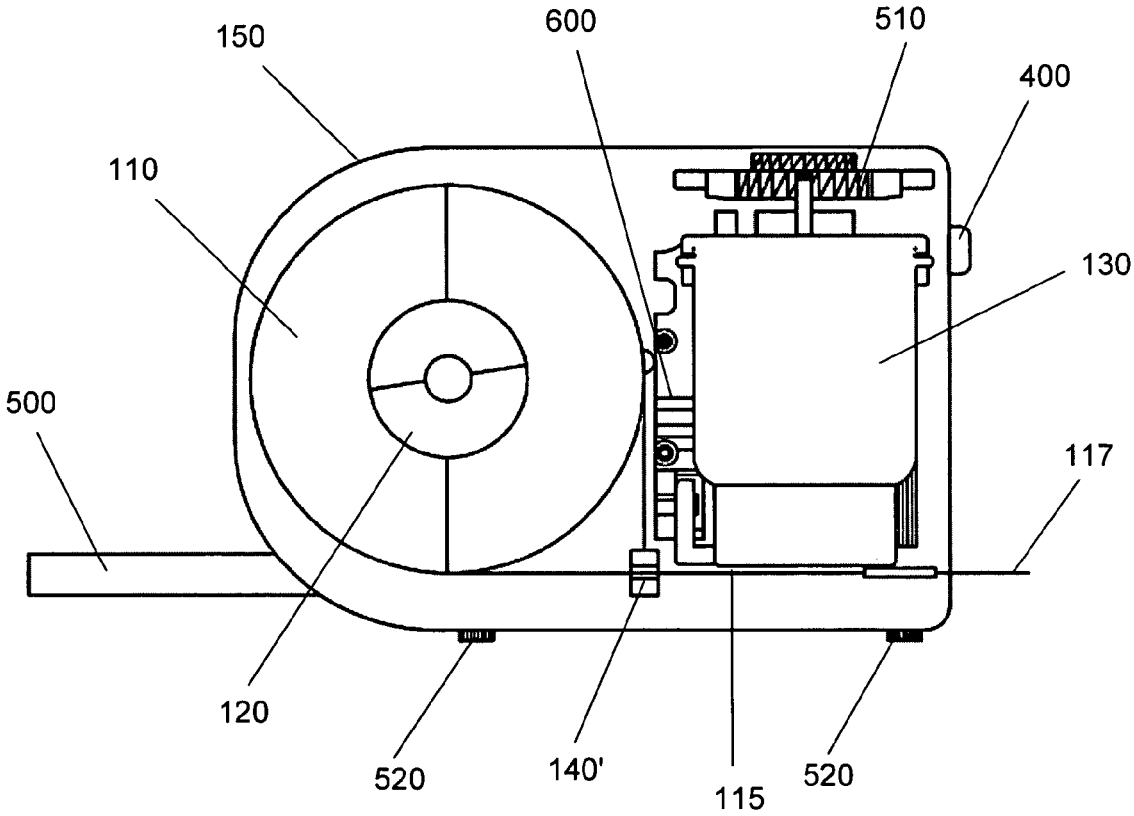
FIG. 7A is a cross-sectional side view of a compact message printer, according to one exemplary embodiment.
Figure 7B:
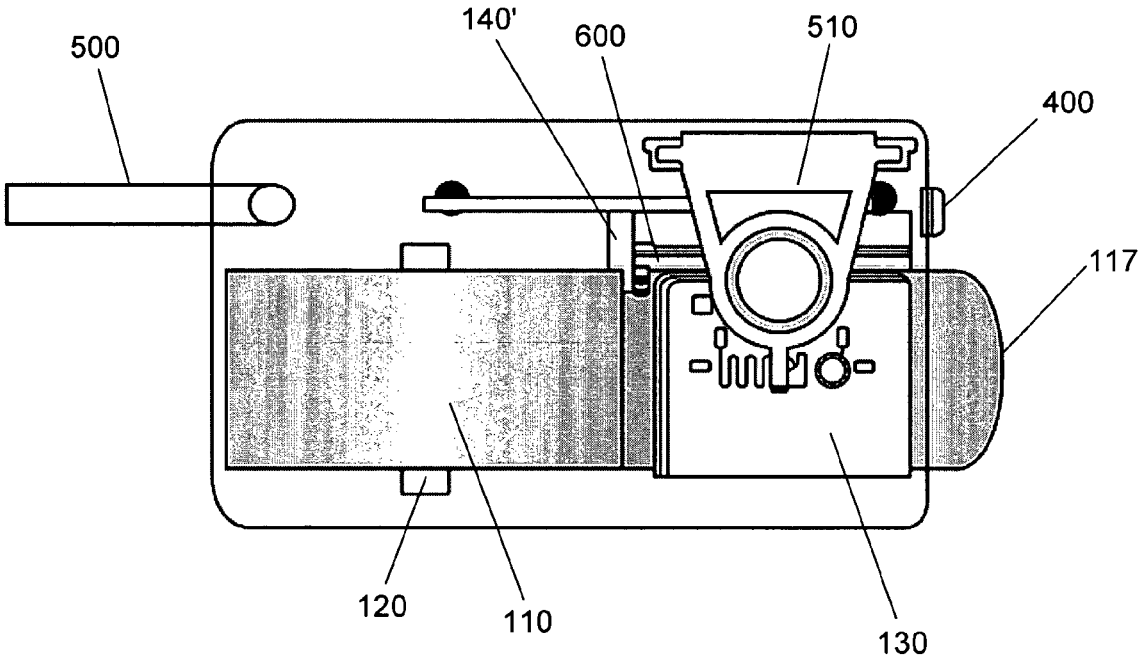
FIG. 7B is a cross-sectional top view of a compact message printer, according to one exemplary embodiment.
Figure 7C:
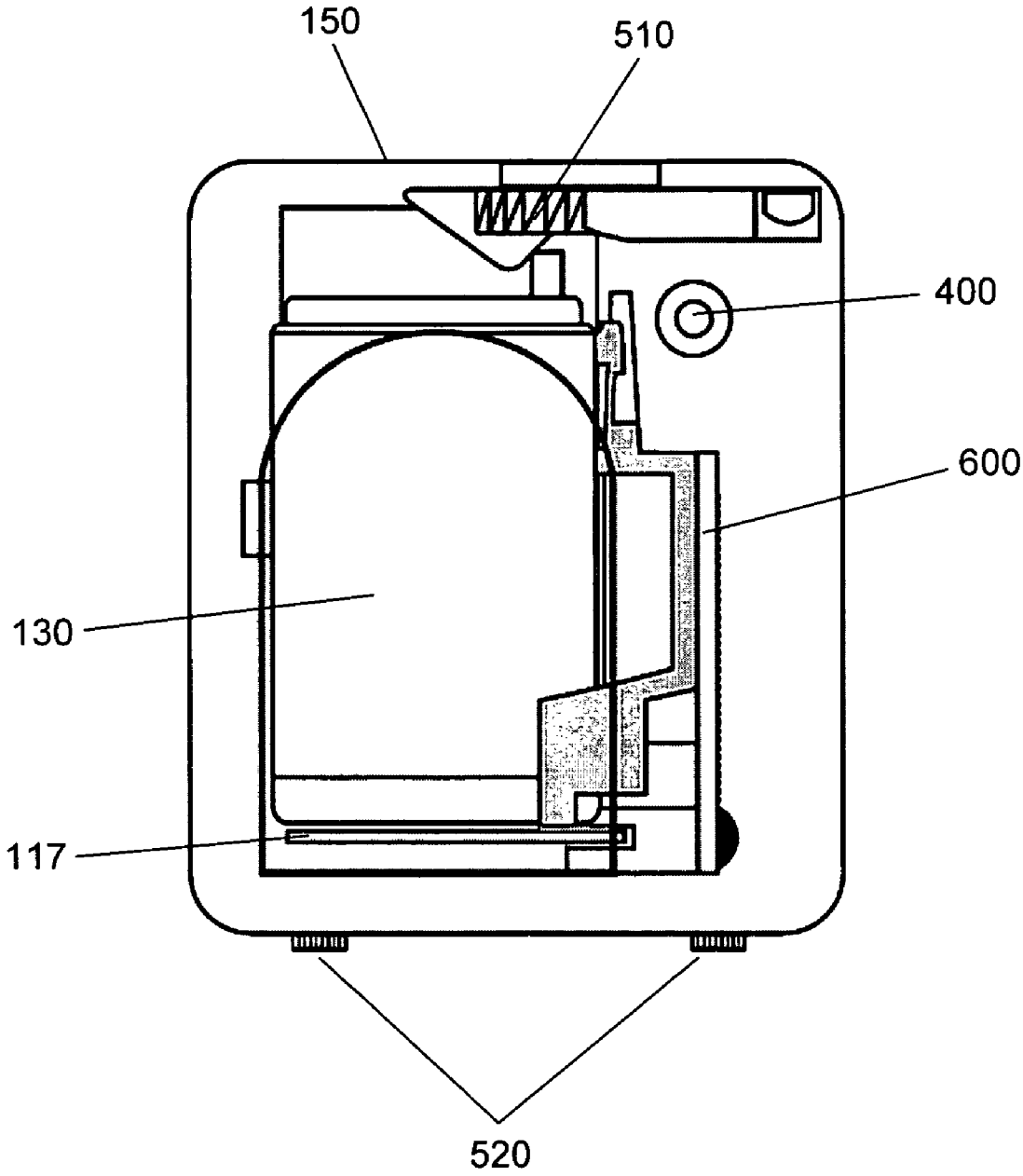
FIG. 7C is a cross-sectional front view of a compact message printer, according to one exemplary embodiment.

FIGS. 7A, 7B, and 7C are cross-sectional views of various orientations illustrating the internal components of the compact message printer (100; FIG. 5). FIG. 7A readily illustrates the protective feet (520) disposed on the under side of the present compact message printer (100; FIG. 5). As illustrated in FIG. 7A, the protective feet (520) are configured to prevent a scratching of a supporting surface. Consequently, the protective feet (520) may be formed out of a soft polymer or a rubber material. While the present compact message printer (100; FIG. 5) is illustrated in FIG. 7A as having the protective feet (520) disposed on the protective case surface parallel to the path of the ink receiving medium, the protective feet, and consequently the compact message printer (100; FIG. 5), may be oriented according to any number of configurations.

FIG. 7B is a top cross-sectional view illustrating the coupling of the communication cable (500) to the SLB (600). The communication cable (500) is communicatively coupled to the SLB (600) and may provide up to three or more functions within the compact message printer (100; FIG. 5). According to one exemplary embodiment, the communication cable (500) provides power for the compact message printer (100; FIG. 5) in order to power the SLB, the encoder (140'), and the pen (130). The power may be supplied to the communication cable from the computing device (310; FIG. 3) or from a battery or a standard power outlet and a transformer. Additionally, the communication cable (500) provides a data transfer medium to facilitate the transfer of data to and from the compact message printer (100; FIG. 5). Moreover, the communication cable (500) serves as a physical leash preventing the printer from being moved away from the computing device (310; FIG. 1).

FIG. 7C is a front cross-sectional view of the present compact message printer (100; FIG. 5) further illustrating how the pen latch (510) securely couples the pen (130) to the protective case (150), according to one exemplary embodiment. As illustrated, when a user desires to remove the pen (130) from the compact message printer (100; FIG. 5), the pen latch (510) is removed or otherwise released allowing the removal and/or replacement of the pen (130). Additionally, according to one exemplary embodiment, the media source (110; FIG. 5) may be replaced when exhausted.

Exemplary User Interface

Figure 8:
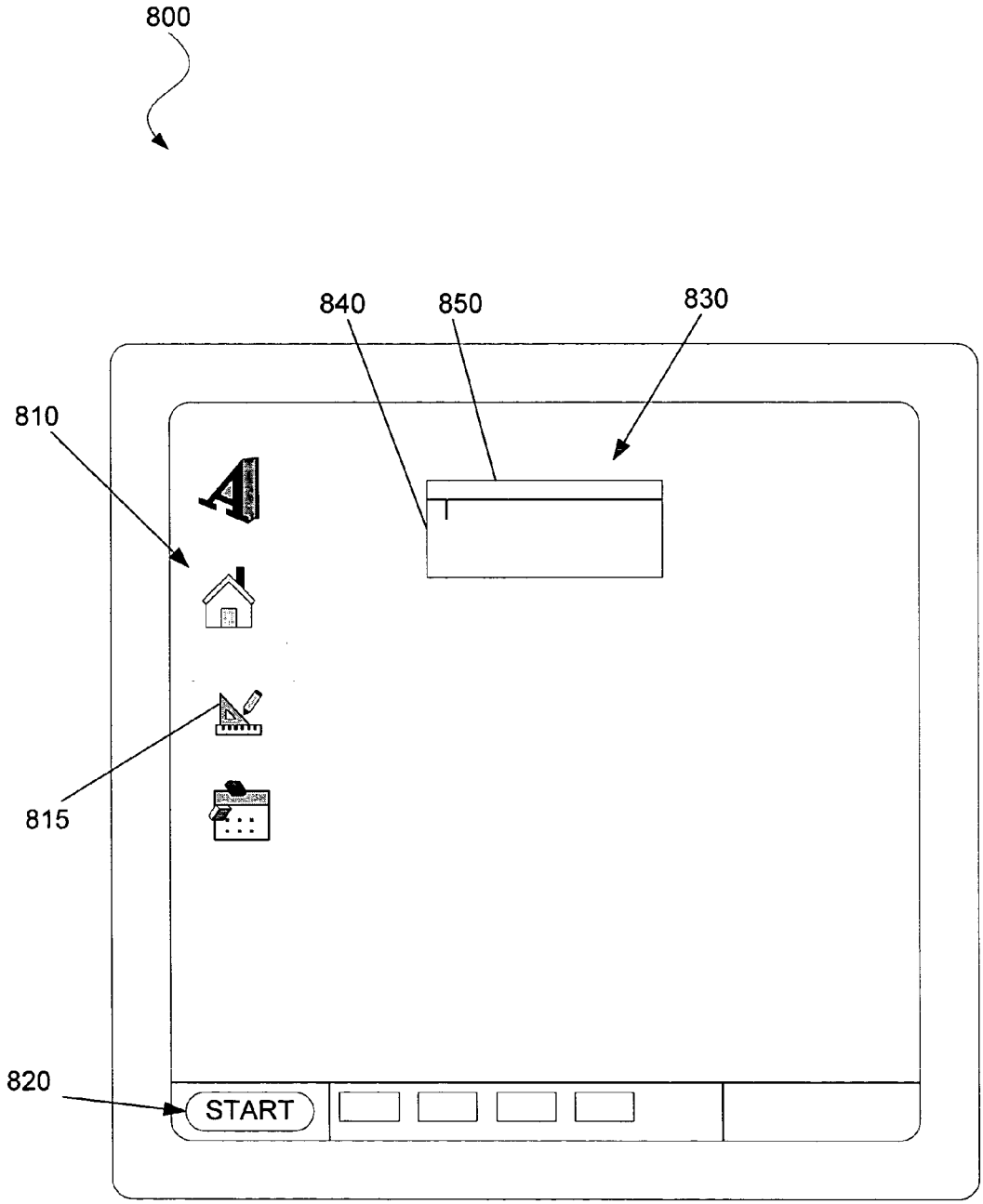
FIG. 8 is a user interface that may be used in conjunction with a compact message printer, according to one exemplary embodiment.

FIG. 8 illustrates a user interface (800) that may be presented to a user in association with the coupling of the present compact message printer (100; FIG. 3) to a computing device (310; FIG. 3). While the present compact message printer (100; FIG. 3) may be coupled to any number of computing devices, the present user interface (800) will be described, for ease of explanation only, in the context of a user interface presented in association with a personal computer (PC). As illustrated in FIG. 8, the user interface (800) may be presented on the display of a computing device (310; FIG. 3) in response to a detected coupling of the present compact message printer. When a coupling is detected, the computing device will access an executable file associated with the compact message printer (100; FIG. 3) causing a small note window (830) to be displayed on the desktop (810).

The note window (830) generated in response to a detected coupling of a compact message printer (100; FIG. 3) may vary in shape, size, and/or color according to any number of exemplary embodiments. However, the present exemplary embodiment presents both a text receiving area (840) and a toolbar (850).

As illustrated in FIG. 6, the text area (840) corresponds in both shape and color to the media source (110; FIG. 5) (note, tab, flag, etc) loaded in the coupled compact message printer (100; FIG. 3) as detected by the SLB (600; FIG. 6). For example, if the media source (110; FIG. 5) is loaded with yellow 1 inch by 3 inch media, a yellow 1 inch by 3 inch text area (840) will be present in the note window (830) that appears on the desktop (810). Accordingly, since the text area (840) of the note window (830) closely corresponds to the size of the media source (110; FIG. 5), the text area is a "what you see is what you get" (WYSIWYG) type of interface. In other words, the text area is configured to only hold an amount of text commensurate with the media source. The note window (830) presented to the user can be configured to sit on top of all applications, desktop icons (815), and toolbars (820). Alternatively, the note window (830) may be configured to remain in the background of the desktop until needed or requested.

The toolbar (850) of the present note window (830) interface is configured to present the user with a number of user preferences. According to one exemplary embodiment, the toolbar (850) of the note window (830) includes a number of drop-down menus presenting a user with a number of font and print quality options associated with text entered into the text area (840) of the note window (830). Additionally, the toolbar (850) may include a drop-down menu allowing a user to hide the note window (830) from view.

Furthermore, according to one exemplary embodiment, the text entered into the text area (840) of the preset note window (830) dynamically corresponds with the data transmitted to the SLB (600) of the compact message printer (100; FIG. 3). Consequently, as text or graphics are modified in the text area (840) of the note window (830), the print data is dynamically modified in the compact message printer (100; FIG. 3).

After a transmitted image or text has been printed by the present compact message printer (100; FIG. 3), the text area is automatically erased in preparation for further input. Additionally, according to one exemplary embodiment, the note window (830) is configured to automatically close when the compact message printer (100; FIG. 3) is decoupled from the associated computing device (310; FIG. 3).

Exemplary Implementation and Operation

Figure 9:
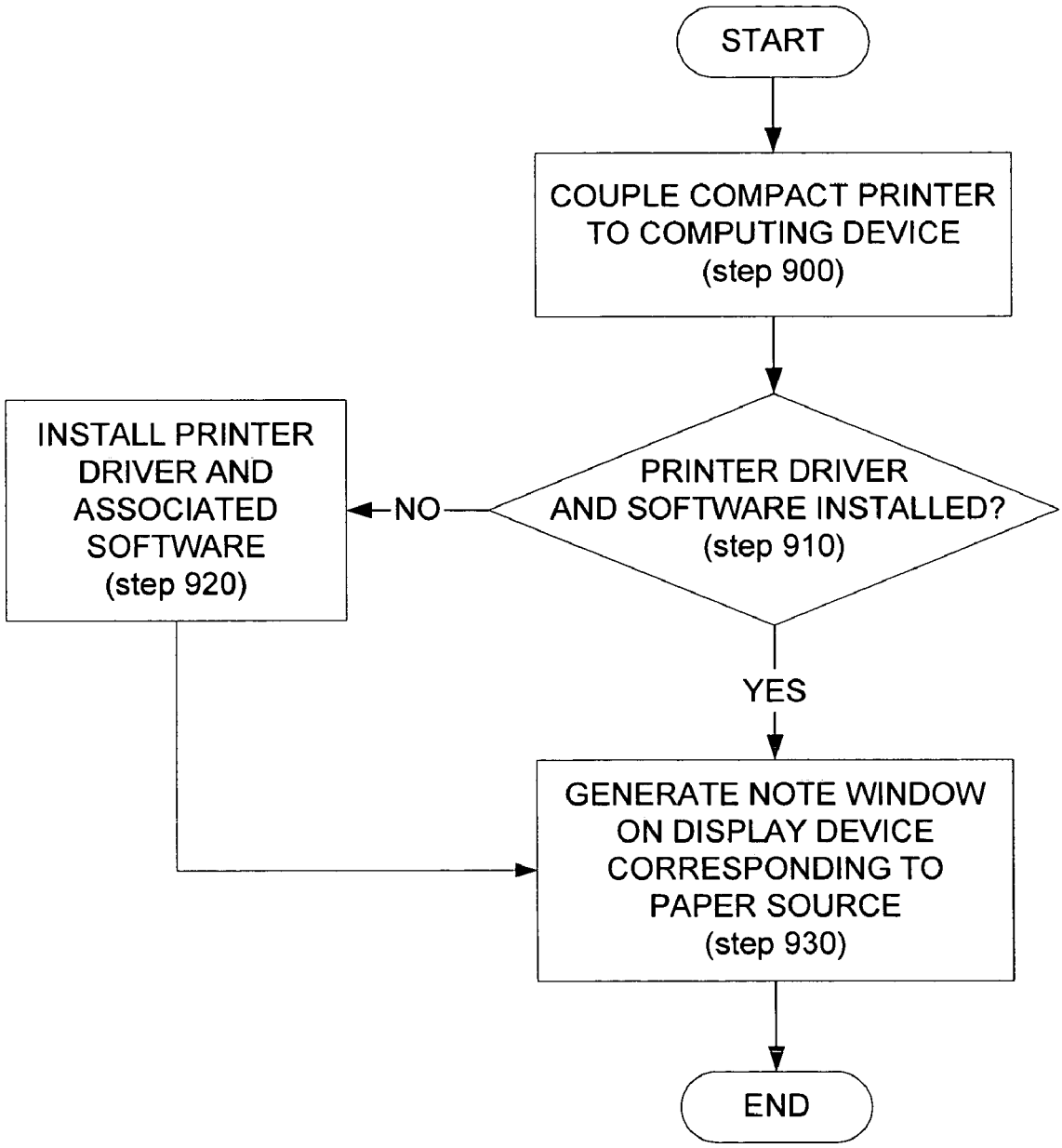
FIG. 9 is a flow chart illustrating a method for coupling a compact message printer to a computing device, according to one exemplary embodiment.

FIG. 9 illustrates a method for automatically generating the above-mentioned note window (830) when the present compact message printer (100; FIG. 3) is detected as coupled to a computing device (310; FIG. 3). As illustrated in FIG. 9, the present method begins by communicatively coupling the compact message printer to the desired computing device (step 900). Once the computing device and the compact message printer are communicatively coupled, the computing device determines whether the appropriate printer driver and software are installed on the computing device (step 910). If the appropriate printer driver and software are not installed on the computing device (NO, step 910), the computing device requests the installation of the corresponding printer driver and its associated software (step 920). If, however, the computing device determines that the printer driver and associated software are accessible by the computing device (YES, step 910), the computing device will access the software and generate a note window (830; FIG. 8) on the display device corresponding to the available media source (step 930). The above-mentioned steps will be described in further detail below.

As illustrated in FIG. 9, the initial step in the method for automatically generating a note window is communicatively coupling the compact message printer (100; FIG. 3) to the computing device (step 900). The compact message printer (100; FIG. 3) may be communicatively coupled to the computing device (310; FIG. 3) using any number of hard wire communication means including, but in no way limited to, a universal serial bus (USB) connection, a serial port connection, a parallel port connection, a serial port connection, or a fire wire connection. Additionally, the compact message printer (100; FIG. 3) may be communicatively coupled to the computing device through a number of wireless communication means including, but in no way limited to, radio frequency (RF) communication, or infrared (I/R) communication.

Regardless of the means of connection incorporated by the present system, once coupled, the computing device recognizes and identifies the coupled compact message printer (100; FIG. 3). The operating system (305; FIG. 3) running on the computing device (310; FIG. 3) may recognize and identify the coupling of the compact message printer (100; FIG. 3). Recognition of the coupling may be performed by an unanticipated load change or the completion of a detection circuit due to the coupling.

Once the compact message printer (100; FIG. 3) is communicatively coupled and recognized by the computing device, the operating system (305; FIG. 3) operating on the computing device (310; FIG. 3) determines whether the appropriate printer driver and software have been installed (step 910). Once the compact message printer is identified, the identification is compared to a list of currently accessible drivers and associated programs resident in the computing device (310; FIG. 3). If the printer driver corresponding to the compact message printer is not present on the computing device (NO, step 920), or any other communicatively coupled data storage device, the computing device will request the installation of the appropriate driver and associated software (step 920). According to one exemplary embodiment, the prompt for the appropriate driver and associated software (step 920) will continue until either the driver data is made available to the computing device or the compact message printer (100; FIG. 3) is decoupled from the computing device.

Once the appropriate printer driver and software are present on the computing device, the computing device will generate a note window (830; FIG. 8) corresponding to the media source loaded in the compact message printer (step 930). With the appropriate driver installed in the computing device (310; FIG. 3), communication between the compact message printer (100; FIG. 3) and the computing device is enabled. Consequently, the SLB (600; FIG. 6) of the compact message printer (100; FIG. 3) may communicate the type of media source detected. Once the type of media source is known, the note window (830; FIG. 8) is generated to correspond in size and/or color with the sensed media source as explained above. The resulting note window (830; FIG. 8) is displayed on the computing device (310; FIG. 3) until a decoupling of the compact message printer (100; FIG. 3) is detected, at which time the note window is closed.

Figure 10:
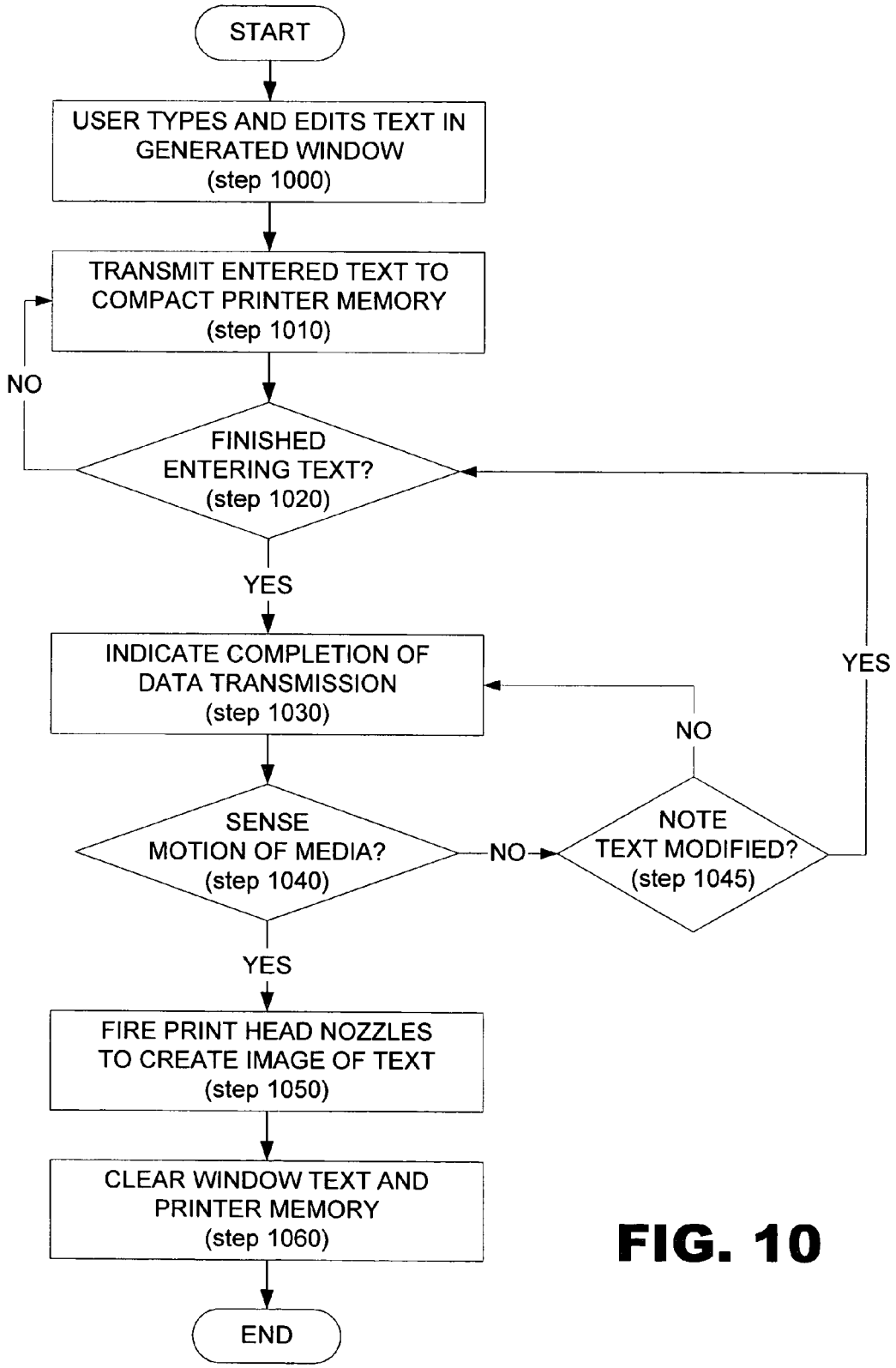
FIG. 10 is a flow chart illustrating a method of using a compact message printer, according to one exemplary embodiment.

FIG. 10 illustrates a method for using the above-mentioned compact message printer (100; FIG. 3) to produce hard copy messages according to one exemplary embodiment. As illustrated in FIG. 10, the method of use begins when the user enters and edits text in the generated note window (step 1000). As noted previously, the generated note window (830; FIG. 8) is a WYSIWYG window that spatially limits the amount of text entered, according to the type of media source incorporated in the compact message printer. Additionally, according to one exemplary embodiment, the user can select a desired font and print quality from window preferences available in the tool bar (850; FIG. 8) of the note window (830; FIG. 8).

As the text is entered into the generated note window (step 1000), data representing the entered text is sequentially transmitted to the memory component of the compact message printer (step 1010). According to one exemplary embodiment, the entered text is rasterized in the computing device immediately after being entered into the generated note window (830; FIG. 8), but prior to transmission to the memory component of the compact message printer (100; FIG. 3). According to one exemplary embodiment, when text data begins to be sent to the memory component of the compact message printer, the function indicator (400; FIG. 4) begins to flash, thereby indicating to the user that data is being transmitted to the compact message printer (100; FIG. 3).

The text continues to be transmitted to the memory component of the compact message printer (NO, step 1020) until the compact message printer detects that all of the data present in the note window (830; FIG. 8) has been transmitted to the compact printer memory (YES, step 1020).

Once all of the data present in the note window (830; FIG. 8) has been transmitted to the memory component of the compact message printer (100; FIG. 3), the completion of data transmission is indicated (step 1030) by the function indicator (400; FIG. 4). According to one exemplary embodiment, the function indicator will indicate a completion of data transmission by ceasing to flash and maintaining a constant illumination. According to this exemplary embodiment, the constant illumination of the function indicator (400; FIG. 4) indicates to a user that the compact message printer (100; FIG. 3) is ready to print the data represented in the note window (830; FIG. 8).

With the necessary data stored in the memory component of the compact message printer (100; FIG. 3), the compact message printer then awaits a detection of movement by the print receiving media (step 1040). If there is no sensed motion of the media for a determined period of time (NO, step 1040), the compact message printer communicates with the computing device to determine if there has been a modification of the text contained in the note window (step 1045). If there has been a modification of the note window (YES, step 1045), the process returns to detecting the termination of text transmission (step 1020). Additionally, in conjunction with the sensing of a modification of the note window, the compact message printer (100; FIG. 3) will purge its memory and the function indicator (400; FIG. 4) will again blink until the memory is fully cleared and the new data is fully received (YES, step 1020). If, however, the text in the note window (830; FIG. 8) has not been modified, the function indicator continues to indicate a completion of data transmission until motion of the media is sensed (YES, step 1040).

When motion of the media is sensed (YES, step 1040), the pen (130; FIG. 5) selectively fires ink from its nozzles (step 1050) to create a representation of the text contained in the note window (830; FIG. 8). According to this exemplary embodiment, when the function indicator is a solid illumination, a user can pull out the exposed print receiving media (117; FIG. 5) to receive printed text. As the user pulls on the exposed print receiving media (117; FIG. 5), the encoder (140'; FIG. 5) of the compact message printer (100; FIG. 3) senses motion of the print receiving media (115; FIG. 5) and fires the correct print head nozzles to create the image of the text that was typed in the note window (830; FIG. 8). As mentioned previously, the drag hub (120; FIG. 5) or other motion dampening device is associated with the media source (110; FIG. 5) within the printer to limit the speed the print receiving media (115; FIG. 5) can be pulled from the compact message printer (100; FIG. 3), thereby controlling image quality.

When the exposed print receiving media (117; FIG. 5) is pulled clear of the compact message printer (100; FIG. 3), the media automatically detaches from the next section of print receiving media (115; FIG. 5), according to one exemplary embodiment. Consequently, the next section of print receiving media (115; FIG. 5) has an exposed portion of print receiving media (117; FIG. 4) and is ready for the next print job. Alternatively, the print receiving media may be separated by a user pulling the media along a serrated edge (160; FIG. 1), upon which an exposed portion of print receiving media is subsequently advanced outside the protective case (150; FIG. 1) for further print jobs.

Moreover, after the image has been created, the text in the note window (830; FIG. 8) and the data in the compact message printer (100; FIG. 3) is cleared (step 1060) in preparation of a subsequent print job. Accordingly, when the exposed print receiving media (117; FIG. 5) is pulled from the compact message printer, the text within the note window (830; FIG. 8) is automatically cleared and the system is ready to receive another text message.

While the above description is given in the context of using the present system and method for producing textual based messages, the present system and method may also be used to generate desired images on the print receiving media (115; FIG. 5). Consequently, the present system and method may be used in a number of situations including, but in no way limited to, creating labels for file folders, printing coupons at a grocery store, generating tickets used in parking garages or movie theatres, printing notes for scrap books and other craft applications, printing instant messaging notes from a computing device, or printing contact or web information.

ALTERNATIVE EMBODIMENTS

Figure 11:
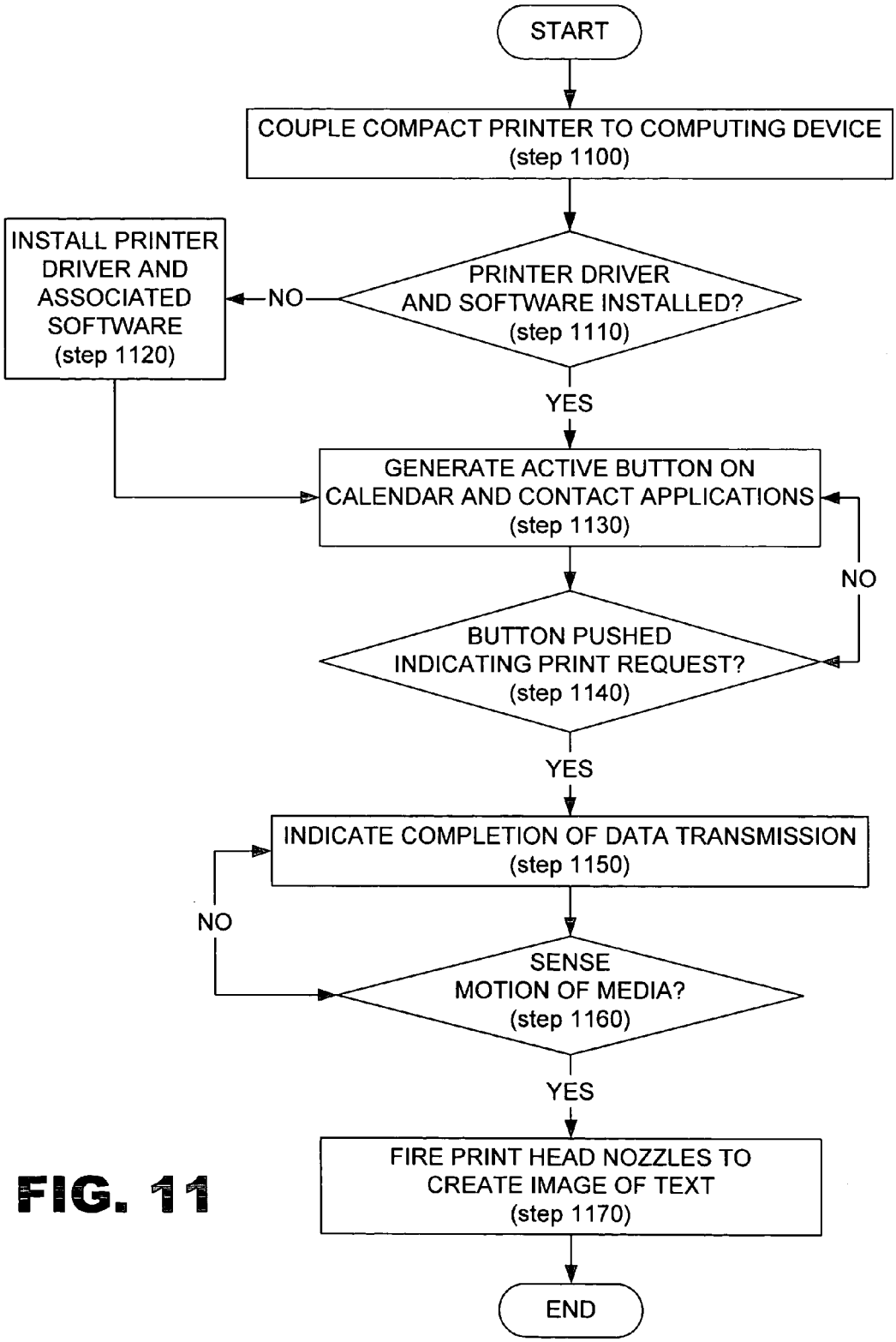
FIG. 11 is a flow chart illustrating a method of using a compact message printer, according to one exemplary embodiment.

FIG. 11 illustrates an alternative method for using the present system and method to produce hard copies of messages. As illustrated in FIG. 11, the use of the compact message printer (100; FIG. 3) may be enabled by coupling the compact message printer to a computing device (step 1100) where it will be automatically detected, as illustrated above. According to one exemplary embodiment, coupling the compact message printer to a computing device entails plugging the printer into an open USB port on a personal computer.

Once the compact message printer (100; FIG. 3) is communicatively coupled to the computing device (step 1100), the computing device (310; FIG. 3) determines whether the appropriate printer driver and associated software have been installed on the computing device (step 1110). If the correct printer driver and associated software have not been correctly installed on the computing device (NO, step 1110), the computing device (310; FIG. 3) prompts the user for the installation of the driver and software (step 1120), as illustrated above with reference to FIG. 9.

If, however, the correct driver and associated software are present in the computing device (YES, step 1110), according to one exemplary embodiment, the computing device generates a button that is added to any calendar and contact applications (step 1130) such as Microsoft® Outlook® that are currently operating on the computing device. According to this exemplary embodiment, the button generated on the calendar and contact applications (step 1130) is configured to allow direct printing to the compact message printer from within the calendar and contact applications.

According to this exemplary embodiment, if the generated button is not pushed (NO, step 1140), no automatic printing occurs. However, if the button is pushed (YES, step 1140), a print request is indicated. According to this exemplary embodiment, the user may select a meeting or a section of contact information on the running application. Once the above-mentioned button is pushed (YES, step 1140), the application is directed to an executable file included in the installed printer driver and associated software. When the executable file is accessed, the selected meeting information or contact information is rasterized and transmitted to the compact message printer (100; FIG. 3). According to this exemplary embodiment, transmission of the information is indicated on the function indicator (400; FIG. 4) by a flashing illumination.

Once all of the desired information has been transferred to a memory component of the compact message printer (100; FIG. 3), the print operation is performed as illustrated above with reference to FIG. 8. More specifically, a solid illumination of the function indicator informs a use that the data transmission is complete (step 1150) and that the exposed print media (117; FIG. 4) may be pulled to generate the printed text. Motion of the print receiving media (115; FIG. 5) is sensed (step 1160) by the encoder (140'; FIG. 5) causing the pen (510; FIG. 5) to fire print head nozzles, thereby generating the desired printed text (step 1170).

In conclusion, the present system and method for economically printing short messages or images from a computing device reduces the overall cost of producing short messages or images while reducing the time necessary to produce such messages or images. Specifically, the present system and method reduce the cost of producing short messages or images by reducing the cost of the printing device. The present compact message printer eliminates costly printer components such as the service station, the carriage, the power supply, the motors, and the precision shafts with rollers, just to name a few. Additionally, the present system and method include a user interface that is automatically generated upon the coupling of the compact message printer, thereby saving a user from the temporally expensive task of starting up a desired word processing application. Moreover, the present user interface reduces reprint attempts by associating the amount of text entered into the user interface to the print receiving media incorporated by the compact message printer.

The preceding description has been presented only to illustrate and describe exemplary embodiments of the present system and method. It is not intended to be exhaustive or to limit the present system and method to any precise form disclosed. Many modifications and variations are possible in light of the above teaching. It is intended that the scope of the present system and method be defined by the following claims.

What is claimed is:

1. A system for printing an image comprising a computing device for receiving a first input to activate a user interface for entering said image; and a printer communicatively coupled to said computing device;

wherein said user interface includes an image receiving area, said image receiving area corresponding to an image receiving media stored in said printer;

wherein said first input includes a detected coupling of said printer to said computing device.

2. The system of claim 1, wherein said computing device is further configured to receive a second input to deactivate said user interface for entering said image.

3. The system of claim 2, wherein said second input comprises a detected decoupling of said printer from said computing device.

4. The system of claim 3, wherein said computing device is further configured to receive a third input to clear said image receiving area.

5. The system of claim 4, wherein said third input comprises a signal indicating a successful printing of said image by said printer.

6. The system of claim 1, wherein said image receiving area is configured to vary in size, vertically and horizontally, according to said image receiving media.

7. The system of claim 1, wherein said image receiving area is configured to vary in color according to said image receiving media.

8. The system of claim 1, wherein said computing device is configured to:

sequentially rasterize images entered into said user interface in said image receiving area; and sequentially transmit said rasterized images to said printer.

9. The system of claim 1, wherein said user interface comprises:

a button generated on an existing application; and an image area on said existing application;

wherein said button is configured to transmit an image in said image area to said printer if said button is selected.

10. The system of claim 1, wherein said printer comprises:

a media source, said media source supplying an image receptive media;

an encoder configured to detect an advancement of said image receptive media; and a pen including an immovable print head configured to deposit ink onto said image receptive media.

11. The system of claim 10, wherein said image receptive media is configured to be advanced adjacent to said pen by a user.

12. The system of claim 11, further comprising a motion dampening device associated with said media source, said motion dampening device being configured to limit a velocity of said advancement.

13. The system of claim 11, wherein said encoder is configured to vary an operation of said pen based on said sensed advancement.

14. The system of claim 10, wherein said printer further comprises:

a data storage device configured to store print data; and a processor communicatively coupled to said data storage device;

wherein said processor is configured to detect said media source and communicate a characteristic of said media source to said computing device based on said identification.

15. The system of claim 14, wherein said data storage device is configured to dynamically change with a modification of an image in said image receiving area.

16. The system of claim 14, further comprising a function indicator configured to indicate a reception of print data in said data storage device.

17. The system of claim 1, wherein said computing device comprises one of a personal computer (PC), a laptop computer, a tablet computer, a personal digital assistant (PDA), a pocket personal computer (pocket PC), or a cellular telephone.

18. The system of claim 1, wherein said image receiving area corresponds in shape to said image receiving media stored in said printer.

19. The system of claim 1, wherein said image receiving area is a same color as said image receiving media stored in said printer.

20. The system of claim 1, wherein said computing device comprises a personal digital assistant (PDA) or a mobile telephone.

21. A method of operating a printer for which a user manually advances an image receiving medium past a print pen, said method comprising:

automatically generating a user interface on a computing device in response to a coupling of a printer to said computing device;

wherein said user interface includes a button for automatically sending selected data from an application on said computing device to said printer;

adding said button to a user interface of said application that is executing on said computing device wherein actuation of said button sends selected data from said application on said computing device to said printer for which a user manually advances an image receiving medium past a print pen; and manually advancing said image receiving medium past a print pen of said printer to produce a printed product based on said selected data from said application.

22. The method of claim 21, further comprising automatically removing said user interface from said computing device in response to a decoupling of said printer.

23. The method of claim 21, further comprising limiting an image receiving area to a size commensurate with said image receiving medium stored in said printer.

24. The method of claim 21, further comprising generating an image receiving area in a color comparable with a color of said image receiving medium stored in said printer.

25. The method of claim 21, further comprising:

sequentially rasterizing data entered into an image receiving area; and sequentially transmitting said rasterized data to a data storage device in said printer.

26. The method of claim 25, further comprising clearing said image receiving area in response to a successful printing of said rasterized data in said printer.

27. The method of claim 25, further comprising purging said data storage device in response to a modification of said data entered into said image receiving area.

28. A system for printing an image comprising:

a means for computing that automatically executes a means for entering said image in response to coupling of a means for printing to said means for computing; and said means for printing communicatively coupled to said computing means, wherein an image receiving media in said means for printing is manually advanced by a user during printing;

wherein said means for entering said image includes an image receiving area, said image receiving area having a shape corresponding to a shape of said image receiving media stored in said printing means.

29. The system of claim 28, wherein said computing means is further configured to receive a second input to deactivate said means for entering said image.

30. The system of claim 29, wherein said second input comprises a detected decoupling of said printing means from said computing means.

31. The system of claim 29, wherein said computing means is further configured to receive a third input to clear said image receiving area, said third input comprising a signal indicating a successful printing of said image by said printing means.

32. The system of claim 28, wherein said means for entering said image is configured to vary in size, vertically and horizontally, according to said image receiving media.

33. The system of claim 28, wherein said means for entering said image is configured to vary in color according to said image receiving media.

34. The system of claim 28, wherein said computing means is configured to:

sequentially rasterize images entered into said means for entering said image; and sequentially transmit said rasterized images to said printing means.

35. The system of claim 28, wherein said means for entering said image comprises:

a button generated on an existing application; and an image area on said existing application;

wherein said button is configured to transmit an image in said image area to said printing means if said button is selected.

36. The system of claim 28, wherein said printing means comprises:

a media source supplying an image receptive medium;

an encoder configured to detect an advancement of said image receiving medium; and a pen including an immovable print head configured to deposit ink onto said image receptive medium.

37. A processor readable medium having instructions thereon for causing a computing device to:

automatically generate a user interface in response to a detection of a printer, said user interface being specific to said printer and not a general word processing application, said user interface including an area configured to receive an image to be printed by said printer; and systematically transmit data received in said area to said detected printer.

38. The processor readable medium of claim 37, wherein said user interface is further configured to correspond with an image receiving media.

39. The processor readable medium of claim 38, wherein said user interface corresponds with said image receiving media in size, vertically and horizontally.

40. The processor readable medium of claim 38, wherein said user interface corresponds with said image receiving media in color.

41. The processor readable medium of claim 37, further having instructions thereon for automatically purging said area configured to receive an image in response to a received signal indicating a successful printing of said image.

42. The processor readable medium of claim 37, further causing said computing device to automatically transmit data received in said area to a memory of said detected printer.

* * * * *

UNITED STATES PATENT AND TRADEMARK OFFICE

CERTIFICATE OF CORRECTION

PATENT NO. : 7,422,384 B2
APPLICATION NO. : 10/912330
DATED : September 9, 2008
INVENTOR(S) : Wesley Schalk et al.

It is certified that error appears in the above-identified patent and that said Letters Patent is hereby corrected as shown below:

Title Page, Item (73), "Assignee", delete "Development," and insert
-- Development Company, --, therefor.

Signed and Sealed this

Twenty-third Day of December, 2008

JON W. DUDAS
*Director of the United States Patent and Trademark Office*